United States Patent [19]

Yoshikawa et al.

[11] Patent Number: 4,872,418

[45] Date of Patent: Oct. 10, 1989

[54] MAGNET ROLL DEVELOPING APPARATUS

[75] Inventors: Masao Yoshikawa, Tokyo; Kimio Nakahata, Kawasaki, both of Japan

[73] Assignee: Canon Kabushiki Kaisha, Tokyo, Japan

[21] Appl. No.: 914,291

[22] Filed: Oct. 2, 1986

[30] Foreign Application Priority Data

Oct. 4, 1985 [JP] Japan ..... 60-221495
Oct. 4, 1985 [JP] Japan ..... 60-221496

[51] Int. Cl.[4] ..... G03G 15/09
[52] U.S. Cl. ..... 118/657; 355/251
[58] Field of Search ..... 355/3 DD; 118/657, 658

[56] References Cited

U.S. PATENT DOCUMENTS 4,292,923 10/1981 Huggins ..... 355/3 DD
4,318,607 3/1982 Bonham et al. ..... 355/3 DD
4,370,056 1/1983 Hays ..... 355/3 DD
4,377,332 3/1983 Tamura ..... 355/3 DD
4,384,545 5/1983 Burnham et al. ..... 355/3 DD
4,468,111 8/1984 Yamagata et al. ..... 355/3 DD
4,557,582 12/1985 Kan et al. ..... 355/3 DD
4,640,808 2/1987 Okumura et al. ..... 355/3 TR

*Primary Examiner*—Patrick R. Salce
*Assistant Examiner*—Jeffrey Sterrett
*Attorney, Agent, or Firm*—Fitzpatrick, Cella, Harper & Scinto

[57] ABSTRACT

A magnet roll, comprising a main body portion of a soft material and having a surface portion which is permanently magnetized, and a supporting portion integrally formed with the main body portion by the same soft material as of the main body portion for mounting the main body portion to a member to which the main body is to be mounted.

31 Claims, 6 Drawing Sheets

MAGNET ROLL DEVELOPING APPARATUS

FIELD OF THE INVENTION AND RELATED ART

The present invention relates to a magnet roll usable with various apparatus, a typical one of which is an image forming apparatus, and most suitably to a developing apparatus for an image forming apparatus which forms an image to be recorded or displayed, using a developing material.

Conventionally, the magnet roll of this kind has been manufactured by bonding a magnet in the form of a sheet on a peripheral surface of a supporting shaft which is of a non-magnetic material such as aluminum or a magnetic material such as ion, or by inserting such a supporting shaft in a cylindrical magnet. When the magnet roll is fixedly mounted in the developing apparatus, for example, the supporting shaft is fixed by end walls of the developing apparatus.

SUMMARY OF THE INVENTION

It has been found that the conventional structure has the following drawbacks which result from the necessity of the separate supporting shaft. Firstly, the supporting shaft required at the center of the magnet roll, has a different configuration from the magnet and is of a material having different magnetic property, the permeability, for example, with the result that the design of the magnetic property of the magnet is rather difficult. Secondary, the diameter of the supporting shaft is required to be larger than a predetermined value in order to provide a required mechanical strength, and therefore, when a small diameter magnet roll, particularly less than 20 mm diameter, is desired, the ratio of the volume of the magnet with respect to the entire magnet roll is so small that it is difficult to obtain a desired magnetic force. Thirdly, it is difficult to provide the positional accuracy between the supporting shaft and the magnet in the process of bonding the magnet on the supporting shaft or in the process of inserting the supporting shaft into the magnet.

Fourthly, the step of fixedly mounting the magnet on the supporting shaft is required, and therefore, the manufacturing of the magnet roll becomes complicated, with the result of an increased cost, which leads to a more expensive developing apparatus.

Accordingly, it is a principal object of the present invention to provide a magnet roll which is easy in designing or providing desired magnetic properties.

It is another object of the present invention to provide a magnet roll which is small in its diameter with a sufficient magnetic force.

It is a further object of the present invention to provide a magnet roll which can be mounted in the apparatus with high positional accuracy.

It is a further object of the present invention to provide a magnet roll which can be manufactured at a lower cost.

It is a further object of the present invention to provide a magnet roll which is capable of conveying a magnetic developer with high accuracy, when used with a developing apparatus.

It is a further object of the present invention to provide a developing apparatus using the magnet roll to enable the developer to be conveyed in a proper manner so as to stabilize the developing performance.

It is a further object of the present invention to provide a developing apparatus which can be smaller in its size.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
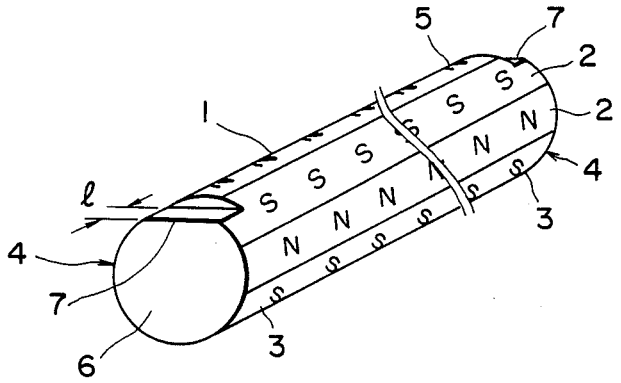
FIG. 1 is a perspective view of a magnet roll according to a first embodiment of the present invention.

Referring now to FIG. 1, there is shown a magnet roll according to a first embodiment of the present invention.

The body of the magnet roll is designated by a reference numeral 1 and is in the form of a solid cylinder column. Around the periphery of the magnet roll 1, magnetic poles 2 are formed by magnetization, and the magnetic poles of the same polarity are arranged in lines in the longitudinal direction of the magnet roll. The polarity of the magnetic poles are alternating in the circumferential direction. The body of the magnet roll 1 is of a synthetic resin or rubber of thermoplastic or thermosetting property such as nylon resin, vinyl chloride, vinyl acetate, chlorinated polyethylene, and nitrile rubber or the like mixed with powder of magnetic material such as ferrite and rare earth elements of magnetic property. The mixture is formed by an injection molding into an intended configuration having an engaging portion which will be described in detail hereinafter. It should be noted that the body of the magnet roll and the engaging portions adjacent the opposite ends are formed simultaneously. During or immediately after the formation, a magnetic field is applied to uniformly direct the magnetic property of the magnetic material, and then, it is magnetized into a desired magnetic pole pattern. In the various embodiments which will be described hereinafter, the method of manufacturing is similar to this.

The diameter of the body of the magnetic roll can be selected as desired, but the most suitable example is 5–30 mm. The length thereof is different depending on the purpose of the use, for example, the maximum width of the transfer sheet usable with a copying machine (an image forming apparatus) using the magnet roll. In the case where the maximum sheet size is A4, the length is 210 mm.

At and adjacent the opposite ends the magnet roll body, there are formed engaging portions 4 which are engageable with locking or engaging portions of the apparatus or members to which the magnet roll is to be mounted. In the shown embodiment, a part of the peripheral surface of the magnet roll is cut away at the opposite ends 3 thereof to provide flat surfaces 7 perpendicular to the respective end surfaces 6. Each of the flat surfaces has a length 1 measured in the longitudinal direction of the magnet roll. Thus, the end portions of the magnet roll itself form the engaging portion 4. The length 1 is so determined that the magnetic property of the magnet roll is not inconveniently influenced for the purpose of developing operation.

FIGS. 4–8 show other examples of the configurations of the engaging portions 4, wherein the same reference numerals as in FIG. 1 have been used to describe the corresponding elements. In each of those embodiments, the engaging portions 4 are formed as flat surfaces 7 perpendicular to the end surfaces 6 adjacent the opposite ends 3 of the magnet roll 1. The FIG. 4 and 8 structures are similar to that of FIG. 1 in that the engaging surface or surfaces are asymmetric with respect to the axis of the magnet roll body 1, and is desirable because the circumferential positioning of the magnet roll is possible.

In the embodiments of FIGS. 1, 4, 5, 7 and 8, the engaging portion 4 which is integrally formed with the body of the magnet roll includes a longitudinal extension of the body of the magnet roll and the flat surface portion or portions 7 which are provided by cutting the circumference of the end portions of the magnet roll away. It is desirable that the engaging portion 4 is press-fitted into the engaging portion 15 of the apparatus, since then, it is not necessary to fix the engaging portion by a separate fixing member, and therefore, a localized concentration of the stress to the magnetic roller can be minimized or prevented so that the uniform supporting force can be applied to the entire engaging portion or the supporting portion. This is effective to prevent an undesirable deformation or deflection of the magnet roller. If the engaging portion 4 is formed only by a circumferential surface such as a hollow or solid cylinder, it is sometimes difficult to obtain a uniform supporting force distribution. For this reason, it is preferable that the engaging portion 4 is of a polygonal configuration. In order to further ensure the prevention of the deformation or deflection, it is preferable that the engaging portion 4 includes the extension of the surface of the magnet roll body. In order to ensure that the magnet roll is mounted into the apparatus only when the magnet roll takes a predetermined rotational position, it is desirable that the engaging portion has an irregular shape portion. For example, it is desired that a particular portion of the magnetic field generating portion is located at the developing position or a developer layer regulating position (a particular positional relation with respect to the developing position or the tip of a blade 10 which will be described hereinafter). The irregular shape portion includes those shown in FIGS. 1, 4 and 8, by which the magnet roll can be inserted into the apparatus only when it takes one particular rotational position and also includes a regular triangle, a regular rectangle, a regular cross, a circumference or the like, a part of which is cut away or deformed (FIGS. 10–14). As another example, the magnet roll can be supported at one point away from the center of the magnet roll.

Figure 4:
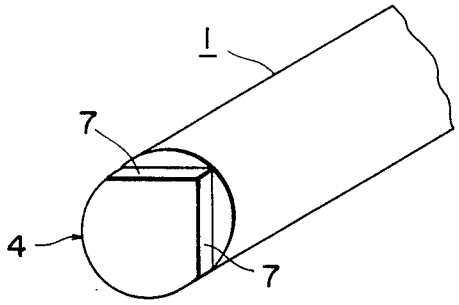
FIGS. 4–8 are perspective views of modifications of FIG. 1.
Figure 5:
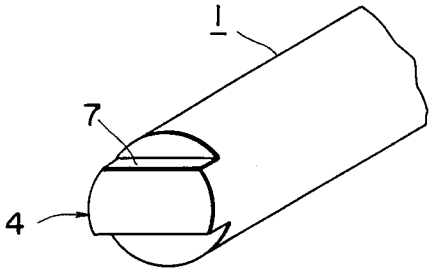
Figure 6:
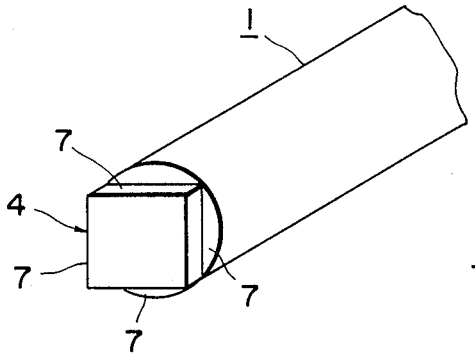
Figure 7:
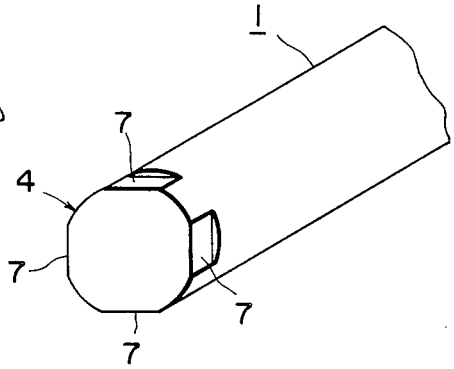
Figure 8:
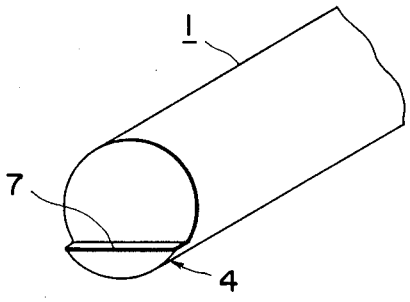

In FIGS. 4–8, the body of the magnet roll is cylindrical, and therefore, the surface of the body is curved. In FIG. 4, the engaging portion 4 includes two flat surface portions 7 which are formed by cutting a part of the circumference away and which are orthogonal, and includes the remaining circumference. In FIG. 5, the two flat surfaces 7 extend parallel. The engaging portion 4 includes the flat surfaces and the remaining circumferential surfaces connecting the flat surfaces. If the lengths of the flat surfaces measured perpendicularly to the longitudinal axis of the magnet roll, are the same, there is no irregular shape portions, but when it is cut away so that the lengths are different, irregular shape portions are provided. In FIG. 6, the engaging portion 4 includes four flat surfaces 7. In FIG. 7, four of the flat surfaces each of which is similar to that of FIG. 1, are formed. Those flat surfaces are not directly connected but are connected by extensions of the circumferential surface of the body of the magnet roll. From the standpoint of mechanical strength, it is desirable that the cross-sectional area of the engaging portion 4 is near that of the cross section of the body of the magnet roll. However, the example of FIG. 1 is also possible wherein the sectional area of the engaging portion is small as shown in the FIG. 8, which corresponds to FIG. 1 embodiment with the modification to provide a small circumferential portion.

Figure 2:
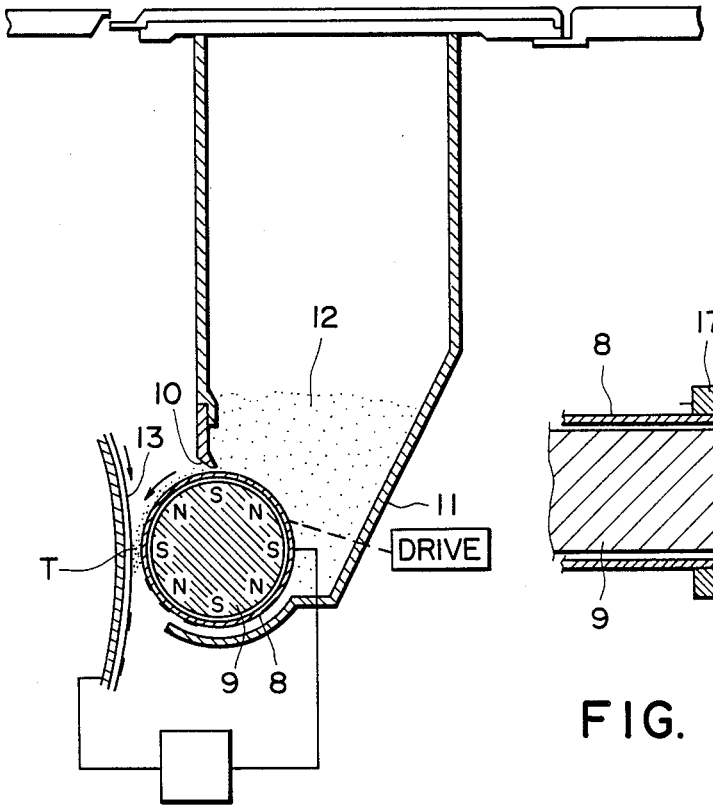
FIG. 2 is a sectional view of a developing apparatus according to an embodiment of the present invention.

FIG. 2 shows a developing apparatus using the magnet roll of the structure described above.

The developing apparatus comprises a nonmagnetic sleeve 8 rotatable, through a drive in the rotational direction indicated by an arrow, a magnet roll 9 which is in the non-magnetic sleeve 8 and which has the structure shown in FIG. 1, and a blade 10 of a magnetic material. The blade 10 is disposed with a small clearance to the surface of the sleeve 8 and is effective to apply the magnetic toner 12 in the hopper 11 on the surface of the sleeve 8 with a regulated thickness, by the magnetic force. Designated by the reference 13 is a latent image bearing member for bearing thereon a latent image such as an electrostatic latent image. The latent image bearing member 13 is movable in the direction indicated by an arrow and is developed by the uniform thickness of the toner layer at the developing portion T.

Figure 3:
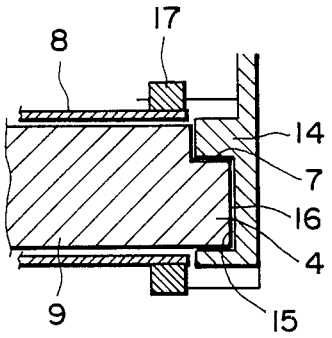
FIG. 3 is a sectional view of a part of a developing apparatus using the magnet roll shown in FIG. 1.

FIG. 3 shows the mounting of the magnet roll. The apparatus to which the magnet roll is mounted includes a side wall 14 having a bottom thick portion. The bottom portion of the side wall 14 is formed into an engaging portion 15 having a configuration corresponding to the engaging portion 4 of the magnet roll 1 at each of the opposite ends 3 thereof. More particularly, the engaging portion 15 of the side wall 14 of the developing apparatus has the engaging portion 15 in the form of a recess of the same configuration as the engaging portion 4 of the magnet roll 1. The engaging portion 15 has a flat surface portion 16, corresponding to the flat surface portion 7 of the engaging portion 4 of the magnet roll. Designated by a reference 17 is a bearing for rotatably supporting the sleeve 8 on the side wall 14, the sleeve 8 being driven for rotation by an unshown driving means.

The engaging portions at the opposite ends 3 of the magnet roll 1 are engaged into the engaging portions 15 of the side walls 14 of the developing apparatus, by which the magnet roll 9 is mounted and positioned with respect to the developing apparatus without twist in the circumferential direction thereof.

Figure 9:
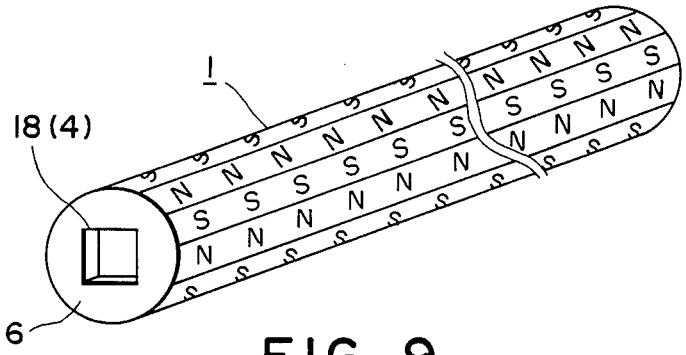
FIG. 9 is a perspective view of a magnet roll according to a second embodiment of the present invention.
Figure 10:
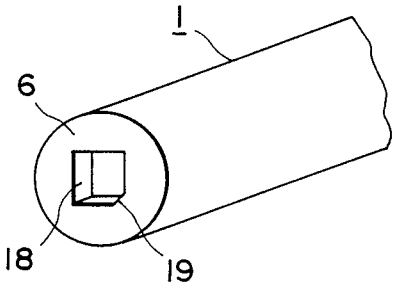
FIGS. 10–13 are perspective views of modifications of the magnet roll of FIG. 9.
Figure 11:
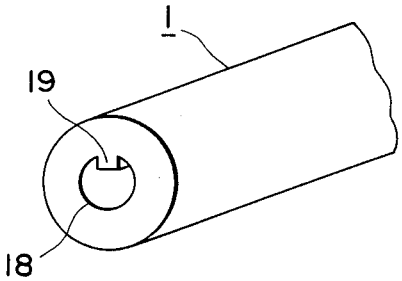
Figure 12:
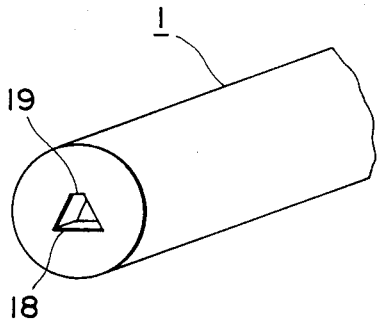
Figure 13:
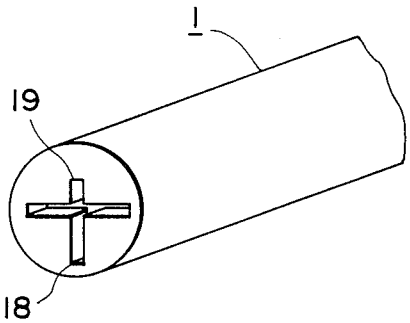

FIG. 9 illustrates a second embodiment of the magnet roll, wherein the same reference numerals as in the first embodiment is assigned to describe the corresponding elements. In this embodiment, the engaging portion 4 at the opposite ends 3 of the magnet roll 1 each include a recess 18 formed at the end surface 6. In this Figure, the recess 18 is of a regular rectangular shape which is symmetrical with respect to the axis of the magnet roll. The depth of the recess 18 is so determined that the magnetic property of the magnet roll is not adversely influenced from the standpoint of the developing performance.

FIGS. 10–13 show examples of the shapes of the recesses 18. The recesses 18 are of the configuration which is asymmetrical to form the irregular shape portion 19.

Figure 14:
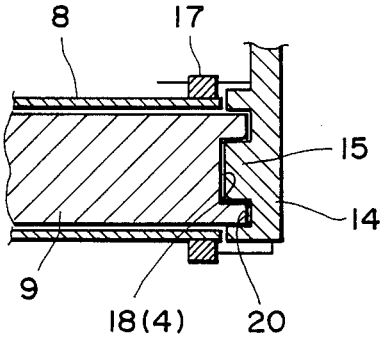
FIG. 14 is a sectional view of a part of a developing apparatus using the magnet roll of FIG. 9.

FIG. 14 is a sectional view of a developing apparatus according to a second embodiment of the present invention using the magnet roll according to the above described second embodiment, wherein the same reference numerals as in the first embodiment is assigned to describe the corresponding elements. In this embodiment, the side walls 14 of the developing apparatus are provided with engaging portions 15 having respective projections of the same shape as the engaging portion 4 of the magnet roll the end engaging portions 4 of the magnet roll are engaged into the respective recesses 20 of the side walls 14.

Figure 15:
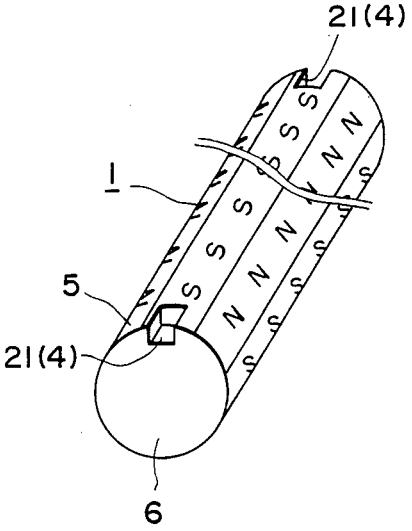
FIG. 15 is a perspective view of a magnet roll according to a third embodiment of the present invention.
Figure 16:
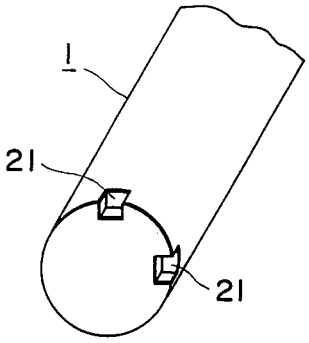
FIGS. 16–20 are perspective views of modifications of the magnet roll of FIG. 15.
Figure 17:
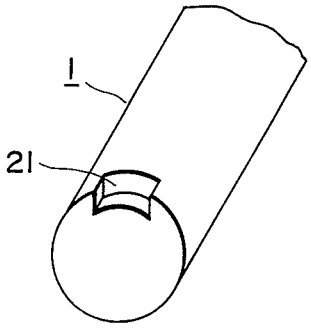
Figure 18:
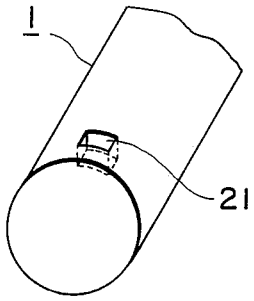
Figure 19:
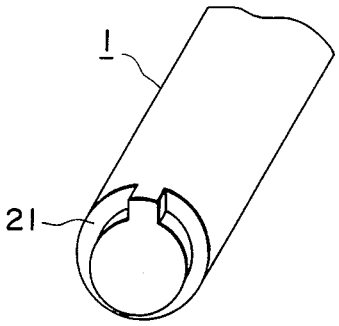
Figure 20:
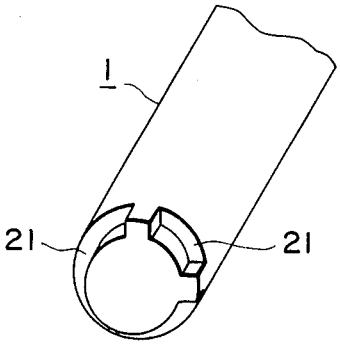

FIG. 15 illustrates a third embodiment of the magnet roll, wherein the same reference numerals as in the first embodiment is used to describe the corresponding elements. In this embodiment, the engaging portions 4 formed at the opposite ends 3 of the magnet roll 1 have cut-away portions or grooves 21 formed at a circumferential portion 5 of the magnet roll 1. The cut away portion 21 is of a cubic shape which opens at the longitudinal end and also at the circumferential periphery of the magnet roll 1. The size of the cut away portion 21 is so determined that the magnetic property is not adversely influenced in the performance of the development.

FIGS. 16–20 show examples of the cut away portion 21 of different shapes, which will be self-explanatory.

Figure 21:
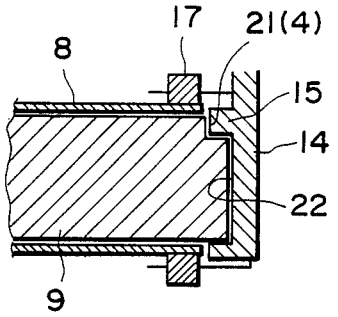
FIG. 21 is a sectional view of a part of a developing apparatus using the magnet roll of FIG. 15.

FIG. 21 is a third embodiment of the developing apparatus according to the present invention using the magnet roll according to the third embodiment, wherein the same reference numerals are assigned to describe the corresponding elements. In this embodiment, a recess 21 is formed in each of the side walls 14 of the developing apparatus to receive the end portion 3 of the magnet roll 1. Additionally, the side wall 14 is provided with an engaging portion 15 in the form of a projection having the same shape as of the cut-away portion 21 of the magnet roll.

Figure 22:
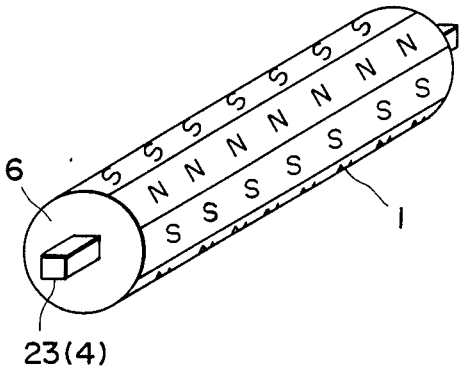
FIG. 22 is a perspective view of a magnet roll according to fourth embodiment of the present invention.

FIG. 22 illustrates a fourth example of a magnet roll, wherein the same reference numerals as in the first embodiment are used to describe the corresponding elements. In the embodiment of FIG. 22, the engaging portion 4 at each of the opposite ends of the magnet roll 1 includes a projection 23 extending from the corresponding end 6. In the shown embodiment, the engaging portion 4 is a projection 23 at the center of the magnet roll, which perpendicularly extends from the end surface 6 of the magnet roll and which has a rectangular cross-section. The sectional configuration of the projection 23 is not limited to the rectangular form, but may be cylindrical or triangular form. And, the position of the projection 23 is not limited to the center of the end surface 6 but may be eccentric.

Figure 23:
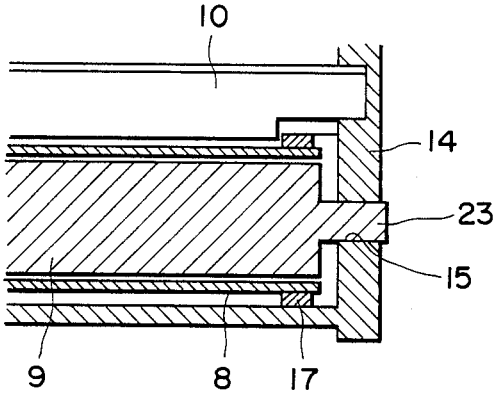
FIG. 23 is a sectional view of a part of a developing apparatus using the magnet roll of FIG. 22.

FIG. 23 illustrates a developing apparatus using the magnet roll of the fourth embodiment, wherein the same reference numerals as in the first embodiment are used to describe the corresponding elements. In this embodiment, a through whole is formed as the engaging portion 15 of the developing apparatus in each of the side walls 14 thereof. The configuration of the through hole is the same as that of the projection 23 of the magnet roll.

It is added that in the fourth embodiment of the magnet roll, the projection 23 may have a polygonal cross section.

The magnet rolls according to the above described embodiments are usable in a cleaning device and not limited to the developing device.

Figure 24:
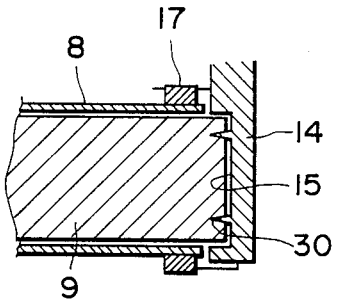
FIG. 24 is a sectional view of a part of a developing apparatus using the magnet roll of FIG. 1.

FIG. 24 illustrates a further example of the developing apparatus, wherein the same reference numerals are used to describe the corresponding elements. In this embodiment, the bottom portion of the lateral wall 14 is provided with a recess 15. In the recess 15 a needle-like projections 30 are integrally formed. The end portion of the magnet roll 1 is inserted into the recess 15 of the side wall 14 and is pushed against the needle-like projections 30 so that the magnet roll 9 is fixed with respect to the side wall 14 by the needle-like projections 30 without twist in the circumferential direction of the magnet roll 9.

Figure 25:
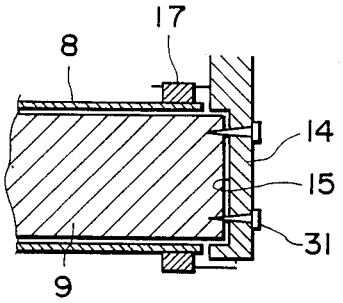
FIG. 25 is a sectional view of a part of a developing apparatus according to a further embodiment of the present invention, using the magnet roll of FIG. 1.

FIG. 25 illustrates a further example of the developing apparatus, wherein the same reference numerals are assigned to describe the corresponding elements. In this embodiment, the magnet roll 9 is fixed by nails 31 from the outside of the side wall 14. In place of the nails 31, screws or the like may be used to facilitate the insertion of the screws or nails. It is desirable that small holes are formed at the end surface 3 of the magnet roll 9 to position the magnet roll with respect to the nails or screws.

The magnet roll 9 may have a polygonal cross-section.

The magnet roll may be used as the cleaning device or the like although the foregoing description has been made with respect to the application thereof to a developing apparatus.

Since the magnet roll is formed by soft material, and the magnet roll is fixed in place by needle-like members. Therefore, the magnet roll can be integrally formed by a plastic magnet or a rubber magnet through a very simple manufacturing steps, so that the cost of the magnetic roll is reduced. Additionally, since a separate supporting shaft is not required, the design of the magnetic property is easier, and furthermore, a sufficient magnetic force can be provided even if the diameter of the magnet roll is small. When the magnet roll is fixed by the needle-like members, it can be fixed without difficulty and with high accuracy.

As described, according to the present invention, the magnet roll is provided with engaging portions at the opposite longitudinal ends of the magnet roll, wherein the engaging portions are of the configuration corresponding to the engaging portion of the member to which the magnet roll is to be mounted. The magnet roll can be integrally formed by a plastic magnet or a rubber magnet, so that the manufacturing steps are simplified with the reduction of the magnet roll. Also, the supporting shaft is not required, with the result that the design of the magnetic property for performance is made easier, and furthermore, the sufficient magnetic force can be provided even if the diameter of the magnet roll is small. By engaging the engaging portion of the magnet roll with the engaging portion of the member or apparatus to which the magnet roll is to be mounted, it can be mounted easily and with high accuracy.

In the developing apparatus according to the present invention, since the above described magnet roll is used, the cost thereof is decreased.

It is understood that the present invention includes any combination of the above described embodiments.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus, comprising:

a magnet roll including a main body portion which is solid in the center thereof and formed of a rubber in which magnetic material is dispersed and having a surface portion which is permanently magnetized, a supporting portion integrally formed with the main body portion from the same rubber as the main body portion;

means engageable with the supporting portion to mount said magnet roll to said developing apparatus;

a developer carrying member, enclosing said magnet roll, for carrying a magnetic developer on the surface thereof by a magnetic force provided by the magnetized portion of said magnet roll; and means for providing relative rotation between said magnet roll and said developer carrying member.

2. An apparatus according to claim 1, wherein the supporting portion of said magnet roll is a projection from an end of the main body, and the member is provided with a recess for press-fittingly receiving the supporting portion.

3. A magnet roll according to claim 1, wherein said magnet roll is a cylindrical or columnar roll which is provided with rubber injection molded to form the main body portion and the supporting portion simultaneously.

4. A magnet roll according to claim 3, wherein said projection has a polygonal cross-section, wherein the projection has an irregular shaped portion to position a particular circumferential portion of the magnet roll to a particular portion of a device having the member.

5. A magnet roll for producing a magnetic force for conveying developer, comprising:

a main body portion which is solid to the center thereof and formed from a synthetic resin in which magnetic material is dispersed and having a surface portion which is permanently magnetized; and a supporting portion integrally formed with the main body portion from the same synthetic resin as the main body portion for mounting the main body portion to a member to which the main body portion is to be mounted, wherein said magnet roll is a cylindrical or columnar roll in which the synthetic resin is injection-molded to form the main body portion and the supporting portion simultaneously.

6. A magnet roll according to claim 5, wherein the supporting portion includes an extension of a circumferential surface of the main body portion.

7. A magnet roll for providing a magnetic force for conveying developer, comprising:

a main body portion which is solid to the center thereof and formed from a synthetic resin in which magnetic material is dispersed and having a surface portion which is permanently magnetized; and a supporting portion integrally formed with the main body portion from the same synthetic resin as the main body portion for mounting the main body portion to a member to which the main body portion is to be mounted, wherein the supporting portion includes a recess formed by cutting away a portion which is not permanently magnetized, and the supporting portion is for engaging with a projection of the member.

8. A magnet roll according to claim 7, wherein said recess opens at a surface of the magnet roll.

9. A magnet roll according to claim 8, wherein said recess opens at a longitudinal end of the magnet roll.

10. A magnet roll according to claim 7, wherein said recess opens at a circumference and at a longitudinal end of the magnet roll.

11. A magnet roll according to claim 7, wherein the projection of the member is in the form of a needle.

12. A magnet roll usable for carrying a magnetic developer, comprising:

a main body portion which is solid to the center thereof and which is formed from a rubber in which magnetic material is dispersed, said main body portion having an outer diameter of not more than 20 mm; and supporting portions projecting out of opposite longitudinal ends of said main body portion, respectively, and made from the same material as the main body portion.

13. A developing apparatus, comprising:

a magnet roll including a main body portion which is solid to the center thereof and formed from a thermoplastic resin in which magnetic material is dispersed and having a surface portion which is permanently magnetized, a supporting portion integrally formed with the main body portion from the same thermoplastic resin as the main body portion;

means engageable with the supporting portion to mount said magnet roll to said developing apparatus;

a developer carrying member, enclosing said magnet roll, for carrying a magnetic developer on the surface thereof by a magnetic force provided by the magnetized portion of said magnet roll; and means for providing relative rotation between said magnet roll and said developer carrying member.

14. An apparatus according to claim 13, wherein the supporting portion of said magnet roll is a projection from an end of the main body portions, and the engageable means is provided with a recess for press-fittingly receiving the supporting portion.

15. A magnetic roll usable for carrying a magnetic developer, comprising:

a main body portion which is solid to the center thereof and which is formed from a synthetic resin in which magnetic material is dispersed, said main body portion having an outer diameter of not more than 20 mm; and supporting portions projecting out of opposite longitudinal ends of said main body portion, respectively, and made from the same material as the main body portion.

16. A developing apparatus, comprising:

a magnet roll including a main body portion which is solid to the center thereof and formed from a thermoplastic resin in which magnetic material is dispersed and having a surface portion which is permanently magnetized, a supporting portion integrally formed with the main body portion from the same thermoplastic resin as the main body portion for mounting the main body portion to a support member to which the main body is to be mounted;

a developer carrying member of a non-magnetic material enclosing said magnet roll; and means for providing relative rotation between said magnet roll and said developer carrying member;

wherein the support member is a part of the developing apparatus, and the supporting portion is engaged with the support member so that said magnetic roll is supported in the developing apparatus, and wherein said magnet roll is fixed to the developing apparatus and has plural magnetic poles arranged in a direction of movement of said developer carrying member, and wherein said magnet roll has an outer diameter of not less than 5 mm and not more than 30 mm.

17. A developing apparatus, comprising:

a magnet roll including a main body portion which is solid to the center thereof and formed from a synthetic resin and having a surface portion which is permanently magnetized, a supporting portion integrally formed with the main body portion from the same synthetic resin as the main body portion for mounting the main body portion to a support member to which the main body is to be mounted, wherein magnetic material is dispersed in the synthetic resin;

a developer carrying member of a non-magnetic material enclosing said magnet roll; and means for providing relative rotation between said magnet roll and said developer carrying member;

wherein the support member is a part of the developing apparatus, and the supporting portion is engaged with the support member so that said magnet roll is supported in the developing apparatus.

18. A developing apparatus according to claim 17, wherein said supporting portion has a flat portion, and said support member has a flat portion engageable with the flat portion of said supporting portion.

19. A developing apparatus comprising:

a magnet roll including a main body portion which is solid to the center thereof and formed from a synthetic resin in which magnetic material is dispersed and having a surface portion which is permanently magnetized, a supporting portion integrally formed with the main body portion from the same synthetic resin as the main body portion for mounting the main body portion to a support member to which the main body is to be mounted;

a developer carrying member of a non-magnetic material enclosing said magnet roll; and means for providing relative rotation between said magnet roll and said developer carrying member;

wherein the support member is a part of the developing apparatus, and the supporting portion is engaged with the support member so that said magnetic roll is supported in the developing apparatus, and wherein said magnet roll is a cylindrical or columnar roll in which the synthetic resin is injection molded to form the main body portion and the supporting portion simultaneously.

20. A magnet roll according to claim 19, wherein the supporting portion is a projection having a polygonal cross-section, wherein the projection has an irregular shaped portion to position a particular circumferential portion of the magnet roll to a particular portion of a device having a support member.

21. A magnet roll for producing a magnetic force for conveying developer, comprising:

a main body portion which is solid to the center thereof and formed from a rubber in which magnetic material is dispersed and having a surface portion which is permanently magnetized; and a supporting portion integrally formed with the main body portion from the same rubber as the main body portion for mounting the main body portion to a member to which the main body portion is to be mounted.

22. A magnet roll according to claim 21, wherein the supporting portion is in a form of a projection projecting in a longitudinal direction of the magnet roll, and wherein the projection is press-fitted into a recess of the member.

23. A magnet roll according to claim 22, wherein said projection has a polygonal cross-section.

24. A magnet roll according to claim 23, wherein the projection has an irregular shaped portion to position a particular circumferential position of the magnet roll to a particular portion of a device having the member.

25. A magnet roll according to claim 23, wherein the supporting portion includes an extension of a circumferential surface of the main body portion.

26. A magnet roll according to claim 21, wherein said magnet roll is a cylindrical or columnar roll which is provided with rubber injection-molded to form the main body portion and the supporting portion simultaneously.

27. A magnet roll according to claim 21, wherein the supporting portion includes a recess formed by cutting away a portion which is not permanently magnetized, and the supporting portion is engaged with a projection of the member.

28. A magnet roll according to claim 27, wherein the projection of the member is in a form of a needle.

29. A magnet roll according to claim 27, wherein said recess opens at a circumference and at a longitudinal end of the magnet roll.

30. A magnet roll according to claim 27, wherein said recess opens at a surface of the magnet roll.

31. A magnet roll according to claim 30, wherein said recess opens at a longitudinal end of the magnet roll.

* * * * *

UNITED STATES PATENT AND TRADEMARK OFFICE

CERTIFICATE OF CORRECTION

PATENT NO. : 4,872,418

DATED : October 10, 1989

INVENTOR(S) : MASAO YOSHIKAWA, ET AL.

It is certified that error appears in the above-identified patent and that said Letters Patent is hereby corrected as shown below:

COLUMN 1

Line 16, "ion," should read --iron,--.
Line 31, "Secondary," should read --Secondly,--.

COLUMN 4

Line 34, "the" should be deleted.
Line 35, "FIG. 1" should read --the FIG. 1--.
Line 40, "drive" should read --drive,--.

COLUMN 5

Line 11, "is" should read --are--.
Line 29, "is" should read --are--.
Line 34, "roll the" should read --roll. The--.
Line 39, "is" should read --are--.

COLUMN 6

Line 14, "through whole" should read --through hole--.
Line 29, "a" (second occurrence) should be deleted.
Line 54, "members." should read --members;--.
Line 55, "Therefore," should read --therefore,--.

COLUMN 7

Line 29, "solid in" should read --solid to--.

UNITED STATES PATENT AND TRADEMARK OFFICE

CERTIFICATE OF CORRECTION

PATENT NO. : 4,872,418

DATED : October 10, 1989

INVENTOR(S) : MASAO YOSHIKAWA, ET AL.

It is certified that error appears in the above-identified patent and that said Letters Patent is hereby corrected as shown below:

COLUMN 8

Line 62, "portions," should read --portion,--.

COLUMN 9

Line 26, "netic roll" should read --net roll--.
Line 58, "apparatus" should read --apparatus,--.

COLUMN 10

Line 10, "netic roll" should read --net roll--.
Line 41, "position" should read --portion--.

Signed and Sealed this

Twenty-first Day of April, 1992

*Attest:*

HARRY F. MANBECK, JR.

*Attesting Officer*

*Commissioner of Patents and Trademarks*